US010383389B2

(12) United States Patent
Beers et al.

(10) Patent No.: US 10,383,389 B2
(45) **Date of Patent: *Aug. 20, 2019**

(54) LIGHTING ASSEMBLY FOR ARTICLES OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/996,692

(22) Filed: Jun. 4, 2018

(65) Prior Publication Data

US 2019/0000176 A1 Jan. 3, 2019

Related U.S. Application Data

(60) Continuation of application No. 15/828,661, filed on Dec. 1, 2017, now Pat. No. 10,004,291, which is a (Continued)

(51) Int. Cl.
*A43B 3/00* (2006.01)
*A43B 5/00* (2006.01)

(Continued)

(52) U.S. Cl.
CPC ..... *A43B 3/001* (2013.01); *A43B 5/00* (2013.01); *A43B 5/001* (2013.01); *A43B 5/002* (2013.01);

(Continued)

(58) Field of Classification Search
CPC ..... A43B 3/0005; A43B 3/001; A43C 1/00; A43C 11/165

(Continued)

(56) References Cited

U.S. PATENT DOCUMENTS 5,033,212 A 7/1991 Evanyk
5,508,899 A 4/1996 Mccormick (Continued)

FOREIGN PATENT DOCUMENTS

CN 109195469 A 1/2019
GB 2215024 A 9/1989

(Continued)

OTHER PUBLICATIONS

"International Application Serial No. PCT/US2017/022182, International Preliminary Report on Patentability dated Sep. 27, 2018", 7 pgs.

(Continued)

*Primary Examiner* — Ted Kavanaugh

(74) *Attorney, Agent, or Firm* — Schwegman Lundberg & Woessner, P.A.

(57) ABSTRACT

An article of footwear can include provisions for facilitating the installation of various components such as a lighting apparatus. During manufacture of the article of footwear, the upper and/or sole structure can include a chamber designed to receive the lighting apparatus. The lighting apparatus can be installed in the chamber after manufacture of the article of footwear. In some cases, the lighting apparatus can include provisions for facilitating the installation of the lighting apparatus in the chamber, including a removable handle portion that can help guide the lighting apparatus within the chamber.

14 Claims, 11 Drawing Sheets

Related U.S. Application Data division of application No. 15/070,070, filed on Mar. 15, 2016, now Pat. No. 9,861,155.

(51) Int. Cl.

| | |
|---|---|
| ***A43B 5/02*** | (2006.01) |
| ***A43B 5/06*** | (2006.01) |
| ***A43B 7/20*** | (2006.01) |
| ***A43B 23/02*** | (2006.01) |
| ***A43B 23/07*** | (2006.01) |
| ***A43C 1/00*** | (2006.01) |
| ***A43C 11/16*** | (2006.01) |

(52) U.S. Cl.

CPC ..... *A43B 5/02* (2013.01); *A43B 5/06* (2013.01); *A43B 7/20* (2013.01); *A43B 23/028* (2013.01); *A43B 23/07* (2013.01); *A43C 1/00* (2013.01); *A43C 11/165* (2013.01)

(58) Field of Classification Search

USPC ..... 36/137

See application file for complete search history.

(56) References Cited

U.S. PATENT DOCUMENTS

| | | | | |
|---|---|---|---|---|
| 5,722,757 | A | 3/1998 | Chien | |
| 5,746,500 | A | 5/1998 | Chien | |
| 5,813,148 | A | 9/1998 | Guerra | |
| 5,879,069 | A | 3/1999 | Chien | |
| 6,082,867 | A | 7/2000 | Chien | |
| 6,874,904 | B2 | 4/2005 | Hsu | |
| 8,056,269 | B2 | 11/2011 | Beers et al. | |
| 9,861,155 | B2 * | 1/2018 | Beers | A43B 5/002 |
| 10,004,291 | B2 | 6/2018 | Beers et al. | |
| 2001/0004808 | A1 | 6/2001 | Hurwitz | |
| 2003/0231485 | A1 | 12/2003 | Chien | |
| 2004/0233658 | A1 | 11/2004 | Hsu | |
| 2012/0192462 | A1 | 8/2012 | Hsu | |
| 2014/0070042 | A1 | 3/2014 | Beers et al. | |
| 2015/0077978 | A1 | 3/2015 | Chen | |
| 2015/0194585 | A1 | 7/2015 | Kim | |
| 2016/0338441 | A1 | 11/2016 | London | |
| 2017/0265559 | A1 | 9/2017 | Beers et al. | |
| 2018/0084861 | A1 | 3/2018 | Beers et al. | |

FOREIGN PATENT DOCUMENTS

| | | | |
|---|---|---|---|
| JP | 2012084392 | A | 4/2012 |
| WO | WO-2017160771 | A2 | 9/2017 |

OTHER PUBLICATIONS

"U.S. Appl. No. 15/070,070, Notice of Allowance dated Aug. 30, 2017", 8 pgs.

"U.S. Appl. No. 15/070,070, Response filed Aug. 8, 2017 to Restriction Requirement filed May 8, 2017", 6 pgs.

"U.S. Appl. No. 15/070,070, Restriction Requirement dated May 8, 2017", 6 pgs

"U.S. Appl. No. 15/828,661, Notice of Allowance dated Mar. 1, 2018", 9 pgs.

"U.S. Appl. No. 15/828,661, PTO Response to Rule 312 Communication dated May 21, 2018", 2 pgs.

"International Application Serial No. PCT/US2017/022182, International Search Report dated Jun. 16, 2017", 3 pgs.

"International Application Serial No. PCT/US2017/022182, Written Opinion dated Jun. 16, 2017", 5 pgs.

"European Application Serial No. 17767294.6, Response filed Apr. 29, 2019 to Communication Pursuant to Rules 161 and 162 dated Nov. 2, 2018", 12 pgs.

* cited by examiner

LIGHTING ASSEMBLY FOR ARTICLES OF FOOTWEAR

PRIORITY APPLICATIONS

This application is a continuation of U.S. patent application Ser. No. 15/828,661, filed Dec. 1, 2017, which application is a divisional application that claims the benefit of priority to U.S. patent application Ser. No. 15/070,070, filed Mar. 15, 2016, now U.S. Pat. No. 9,861,155, which issued Jan. 9, 2018, the contents of both which are incorporated herein by reference in their entireties.

BACKGROUND

The present embodiments relate generally to articles of footwear and the incorporation of electroluminescent devices in an article of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to a kit of parts for facilitating assembly of an article of footwear comprising a lighting apparatus and an article of footwear. The lighting apparatus includes a base component, and the base component is an elongated, flexible strip. Furthermore, the base component includes a removable portion attached to a forward portion, an intermediate portion, and a rearward portion, where the intermediate portion extends between the forward portion and the rearward portion. There are a plurality of light-emitting devices arranged on the intermediate portion. In addition, the article of footwear includes an elongated channel, the elongated channel comprising a first opening and a second opening. The base component extends through the first opening, through the elongated channel, and through the second opening, such that the removable portion extends outward from the second opening. Furthermore, the removable portion is configured to be removed from the lighting apparatus following insertion of the intermediate portion into the elongated channel.

In another aspect, the present disclosure is directed to a lighting system for articles of footwear comprising a lighting apparatus and an article of footwear. The lighting apparatus includes a base component, where the base component comprises an elongated, flexible strip. The base component includes a removable portion attached to a forward portion, an intermediate portion, and a rearward portion, where the intermediate portion extends between the forward portion and the rearward portion. In addition, a plurality of light-emitting devices are arranged on the intermediate portion. The article of footwear includes an elongated channel, the elongated channel comprising a first opening and a second opening. Furthermore, the intermediate portion is enclosed within the elongated channel in the article of footwear. The first opening has a first width, the intermediate portion has a second width, and the rearward portion has a third width, where the second width is smaller than the first width, and where the third width is larger than the first width, such that the rearward portion is configured to remain outside of the elongated channel.

In another aspect, the present disclosure is directed to a method of assembling a lighting apparatus with an article of footwear comprising inserting a removable portion of the lighting apparatus into a first opening of an elongated channel, the elongated channel being formed in the article of footwear, and guiding the lighting apparatus further into the elongated channel such that the removable portion emerges from a second opening of the elongated channel. The method also includes pulling the removable portion out of the elongated channel from the second opening and positioning an intermediate portion of the lighting apparatus within the elongated channel, where the intermediate portion comprises a plurality of light-emitting devices. In addition, the method comprises removing the removable portion from the remainder of the lighting apparatus.

Other systems, methods, features, and advantages of the embodiments will be, or will become, apparent to one of ordinary skill in the art upon examination of the following figures and detailed description. It is intended that all such additional systems, methods, features, and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
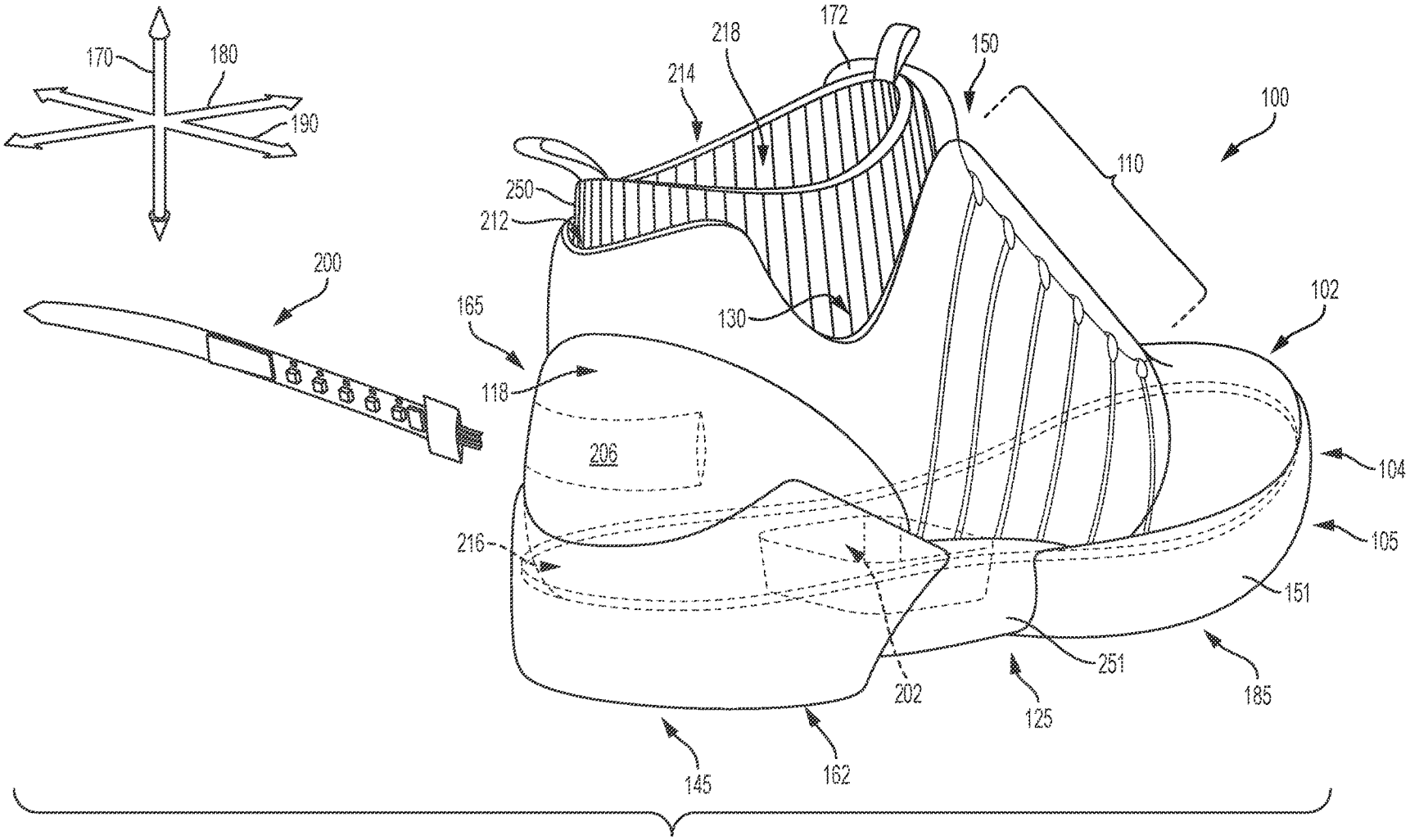
FIG. 1 is an isometric rear view of an embodiment of an article of footwear and a lighting apparatus.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading toward the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe's interior in a completed shoe. The "outer side" or "exterior" of an element refers to the face of that element that is (or will be) oriented away from the shoe's interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

Referring to FIG. 1, an isometric side view of an article of footwear ("article") 100 that is configured with a tensioning system 150 is depicted. In the current embodiment, article 100 is shown in the form of an athletic shoe, such as a running shoe. However, in other embodiments, tensioning system 150 may be used with any other kind of footwear including, but not limited to, hiking boots, soccer shoes, football shoes, sneakers, running shoes, cross-training shoes, rugby shoes, basketball shoes, baseball shoes as well as other kinds of shoes, Moreover, in some embodiments article 100 may be configured for use with various kinds of non-sports-related footwear, including, but not limited to, slippers, sandals, high-heeled footwear, loafers as well as any other kinds of footwear. As discussed in further detail below, a tensioning system may not be limited to footwear and in other embodiments a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100, but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size, and/or color. For example, in embodiments where article 100 is a basketball shoe, upper 102 could be a high-top upper that is shaped to provide high support on an ankle. In embodiments where article 100 is a running shoe, upper 102 could be a low-top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to impart properties such as light weight, durability, air permeability, wear resistance, flexibility, and comfort. Upper 102 may define an opening 130 through which a foot of a wearer may be received into the interior void.

At least a portion of sole structure 104 may be fixedly attached to upper 102 (for example, with adhesive, stitching, welding, or other suitable techniques and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running, or other ambulatory activities. The configuration of sole structure 104 may vary significantly in different embodiments to include a variety of conventional or nonconventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is hard or soft. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with the ground's surface.

In some embodiments, sole structure 104 may include multiple components, which may, individually or collectively, provide article 100 with a number of attributes, such as support, rigidity, flexibility, stability, cushioning, comfort, reduced weight, or other attributes. In some embodiments, sole structure 104 may include an insole/sockliner, a midsole 151, and a ground-contacting outer sole member ("outsole") 162, which may have an exposed, ground-contacting lower surface. In some cases, however, one or more of these components may be omitted. In one embodiment, sole structure 104 may comprise a sole plate 251, which can receive or secure a component or portions of tensioning system 150. For example, in FIG. 1, sole plate 251 is disposed in a recess formed in midsole 151.

Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foam, or other polymer foam materials. Accordingly, the insole may, by virtue of its compressibility, provide cushioning, and may also conform to the foot in order to provide comfort, support, and stability.

Midsole 151 may be fixedly attached to a lower area of upper 102, for example, through stitching, adhesive bonding, thermal bonding (such as welding), or other techniques, or may be integral with upper 102. Midsole 151 may be formed from any suitable material having the properties described above, according to the activity for which article 100 is intended. In some embodiments, midsole 151 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Midsole 151 may extend through each of forefoot region 105, midfoot region 125, and heel region 145, and between lateral side 185 and medial side 165 of article 100. In some embodiments, portions of midsole 151 may be exposed around the periphery of article 100, as shown in FIG. 1. In other embodiments, midsole 151 may be completely covered by other elements, such as material layers from upper 102. For example, in some embodiments, midsole 151 and/or other portions of upper 102 may be disposed adjacent to a bootie 214 disposed inside of the interior void of article 100. However, other embodiments may not include a bootie.

Furthermore, as shown in FIG. 1, article 100 may include a tongue 172, which may be provided near or along a throat opening. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include tensioning system 150. Tensioning system 150 may comprise various components and systems for adjusting the size of an opening 130 leading to an interior void (see FIG. 2) and tightening (or loosening) upper 102 around a wearer's foot. Some examples of different tensioning systems that can be used are disclosed in Beers et al., U.S. Patent Publication Number 2014/0070042 published Mar. 13, 2014, (previously U.S. patent application Ser. No. 14/014,555, filed Aug. 30, 2013) and entitled "Motorized Tensioning System with Sensors" and Beers et al., U.S. Pat. No. 8,056,269, issued Nov. 15, 2011 (previously U.S. Patent Publication Number 2009/0272013, published Nov. 5, 2009) and entitled "Article of Footwear with Lighting System," the disclosures of which are incorporated herein by reference in their entirety.

Furthermore, the embodiments described herein may also include or refer to techniques, concepts, features, elements, methods, and/or components from U.S. Patent Publication Number 2016-0345679 A1, published Dec. 1, 2016, (previously U.S. patent application Ser. No. 14/723,972, filed May 28, 2015), titled "An Article Of Footwear And A Method Of Assembly Of The Article Of Footwear," U.S. Patent Publication Number 2016-0345653 Al, published Dec. 1, 2016 (previously U.S. patent application Ser. No. 14/723,832, filed May 28, 2015), titled "A Lockout Feature For A Control Device," U.S. Patent Publication Number 2016-0345654, published Dec. 1, 2016, (previously U.S. patent application Ser. No. 14/723,880, filed May 28, 2015), titled "A Charging System for an Article of Footwear," U.S. Patent Publication Number 2016-0345671 A1, published Dec. 1, 2016, now U.S. Pat. No. 9,894,954 which issued on Feb. 20, 2018, (previously U.S. patent application Ser. No. 14/723,994, filed May 28, 2015), titled "A Sole Plate for an Article of Footwear," U.S. Patent Publication Number 2016-0345655, published Dec. 1, 2016, (previously U.S. patent application Ser. No. 14/724,007, filed May 28, 2015), titled "A Control Device for an Article of Footwear," and U.S. Patent Publication Number 2016-0144613, published May 26, 2016, now U.S. Pat. No. 9,849,669 which issued on Dec. 26, 2017, (previously U.S. patent application Ser. No. 14/944,705, filed Dec. 1, 2015), titled "An Automated Tensioning System For An Article Of Footwear," the entirety of each application being herein incorporated by reference.

In some embodiments, tensioning system 150 may comprise one or more laces, as well as a motorized tensioning device. A lace as used with article 100 may comprise any type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township, N.J., although other kinds of extended chain, high modulus polyethylene fiber materials can also be used as a lace. The arrangement of the lacing depicted in the Figures is only intended to be exemplary, and it will be understood that other embodiments are not limited to a particular configuration for lacing elements.

Some embodiments may include one or more compartments, recesses, channels, or other receiving portions that are disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100. For example, in FIG. 1, article 100 is depicted with an embodiment of a rear compartment or a channel 206. Channel 206 is disposed in heel region 145 of article 100, formed within a rear wall portion 118. In some embodiments, rear wall portion 118 is associated with the region of article 100 that can contact the heel of a foot.

FIG. 1 also provides a view of an embodiment of a sole compartment 202 that is formed in sole structure 104. As noted above, in different embodiments, article 100 may include other elements. Referring to FIG. 1, article 100 includes bootie 214 and a collar lining 212 that are disposed within upper 102. Bootie 214 and collar lining 212 may be removed, separated, or detached from article 100 in some embodiments. In one embodiment, the position or arrangement of bootie 214 and collar lining 212 may be adjusted within article 100. In some embodiments, bootie 214 and collar 212 or other elements may be moved (or removed) and then reinserted or replaced into article 100 (i.e., returned to their original arrangement within article 100) in different embodiments. This can occur after manufacture of article 100, as discussed further below. Bootie 214, collar lining 212, and/or other such adjustable inner lining materials or elements (such as a tongue) associated with the disclosed embodiments of article 100 may be referred to as "removable elements" for purposes of this description and the claims.

In some embodiments, the various compartments may be designed, dimensioned, and/or configured to receive different types of components or elements. For example, sole compartment 202, which is associated with sole plate 251, comprises a cavity that can receive a power source for other elements of article 100.

In addition, in some embodiments, channel 206 is disposed within upper 102, adjacent to bootie 214 and collar lining 212. In some embodiments, channel 206 can comprise a sleeve-like region or portion of upper 102. In other words, channel 206 can be shaped as a generally tubular portion, with two ends. As will be discussed further below, each end may be configured as slots or openings that can allow entry into an interior of channel 206. Thus, in different embodiments, article 100 may include areas that are disposed in different regions and can allow for the removable insertion, attachment, or installation of other objects, elements, or components.

Furthermore, it should be understood that the embodiments described herein with respect to the compartments in FIG. 1, and in further figures, may be applicable to articles that do not include a tensioning system. In other words, the method of manufacture where an article can include compartments, and/or the article, which includes such compartments, may be utilized in any type or configuration of footwear or article of apparel.

As noted earlier, in some embodiments, bootie 214 may be provided within upper 102. In one embodiment, bootie 214 can substantially surround or bound an interior void 218 in article 100 and can be removed for insertion of components into article 100. Similarly, as indicated above, collar lining 212 may be removable from interior void 218. For example, bootie 214 and/or collar lining 212 can be pulled or removed from interior void 218 of upper 102. It should be understood that in other embodiments, article 100 may not include collar lining 212 and/or bootie 214, or the configuration of collar lining 212 and/or bootie 214 may differ from that illustrated herein. In some embodiments, the removal of collar lining 212 and/or bootie 214 may expose or facilitate access to regions within article 100 to one or more compartments. In one embodiment, the displacement of bootie 214, collar lining 212, and/or other removable elements (for example, a tongue) can expose different areas within interior void 218.

In different embodiments, article 100 may include or incorporate one or more components that can be secured or attached to article 100. In some embodiments, there may be one or more components associated with article 100 that are configured to work with and/or provide various functions or features to article 100. As noted above, article 100 may be manufactured to accommodate one or more components in a manner that allows ready and secure incorporation of components post manufacture. In some embodiments, a compartment as described above with respect to channel 206 can be configured to receive specific components.

Figure 2:
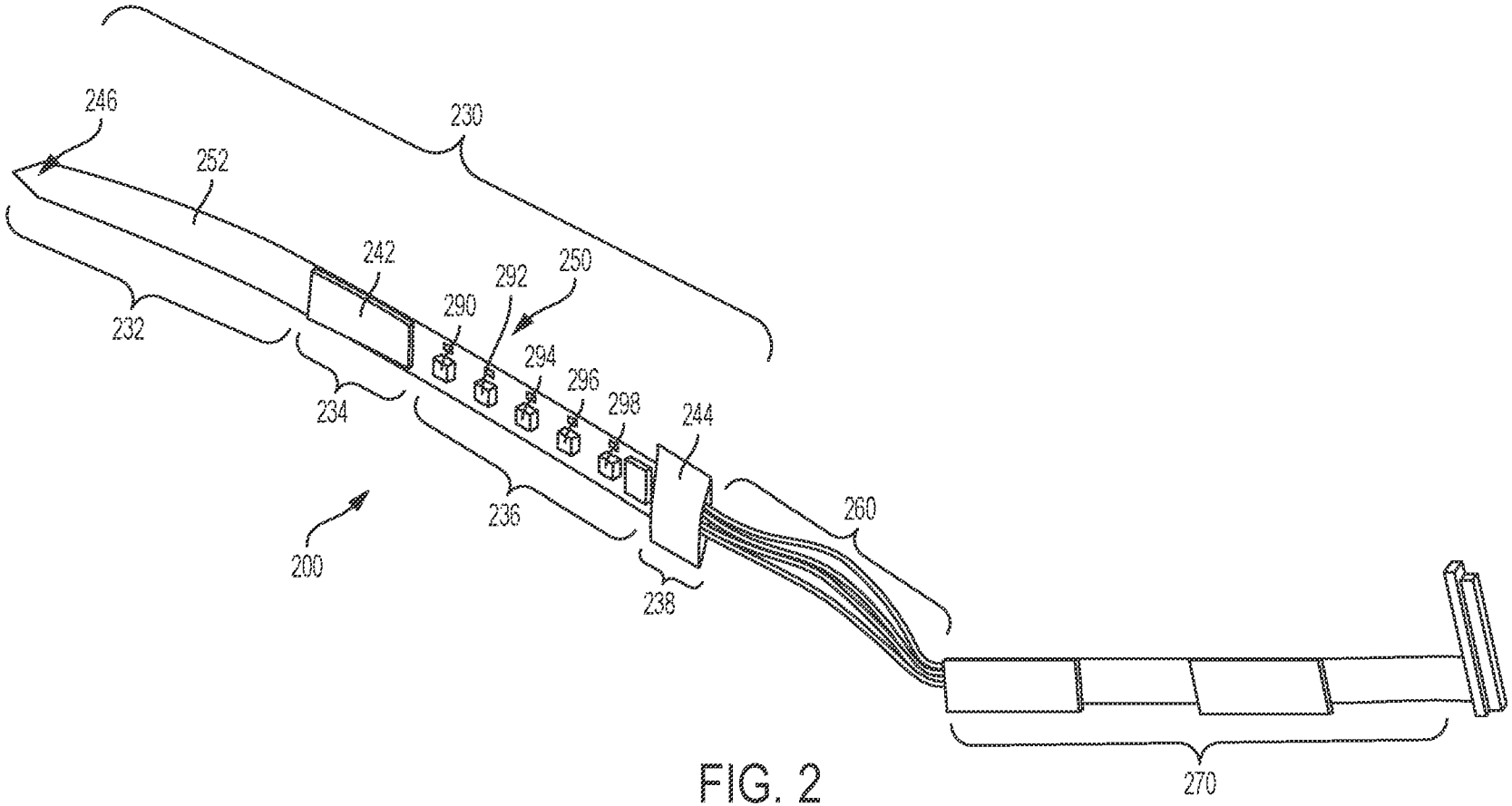
FIG. 2 is a top-down isometric view of an embodiment of a lighting apparatus.
Figure 3:
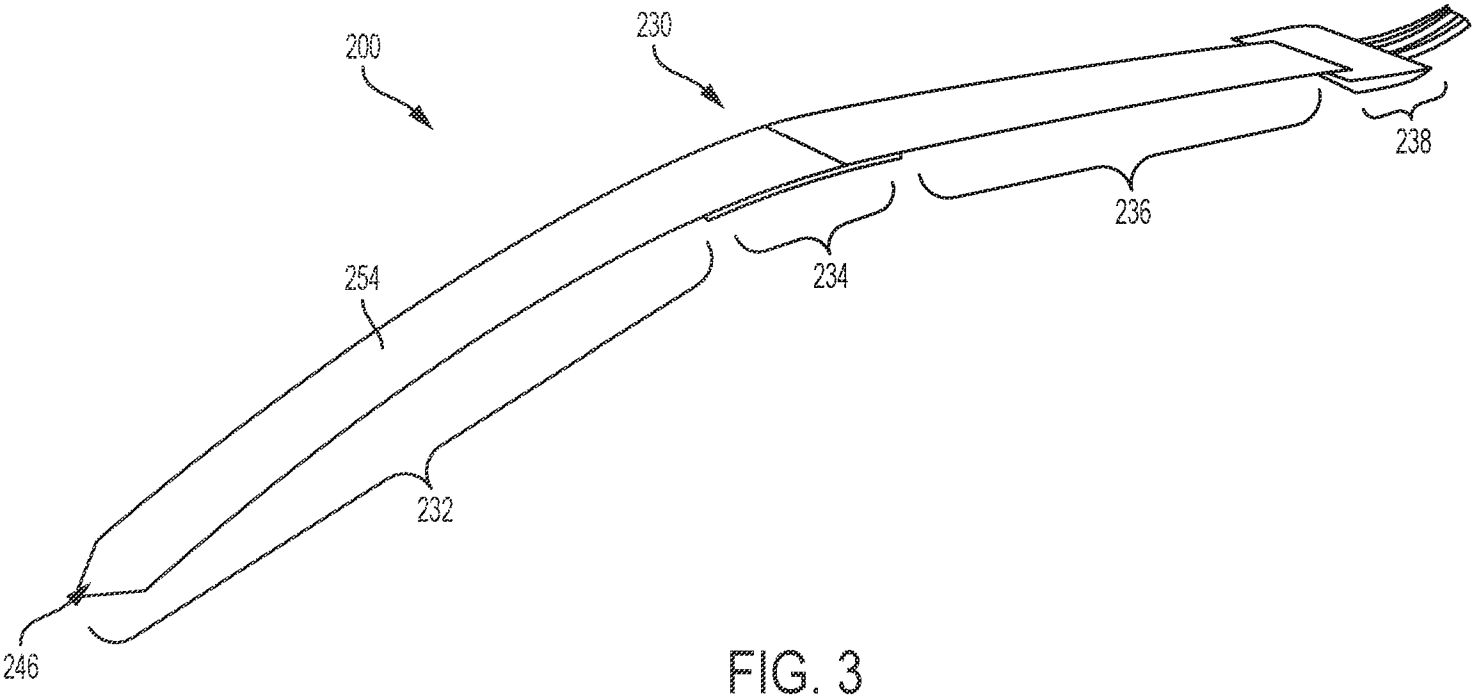
FIG. 3 is a bottom view of an embodiment of a lighting apparatus.
Figure 4:
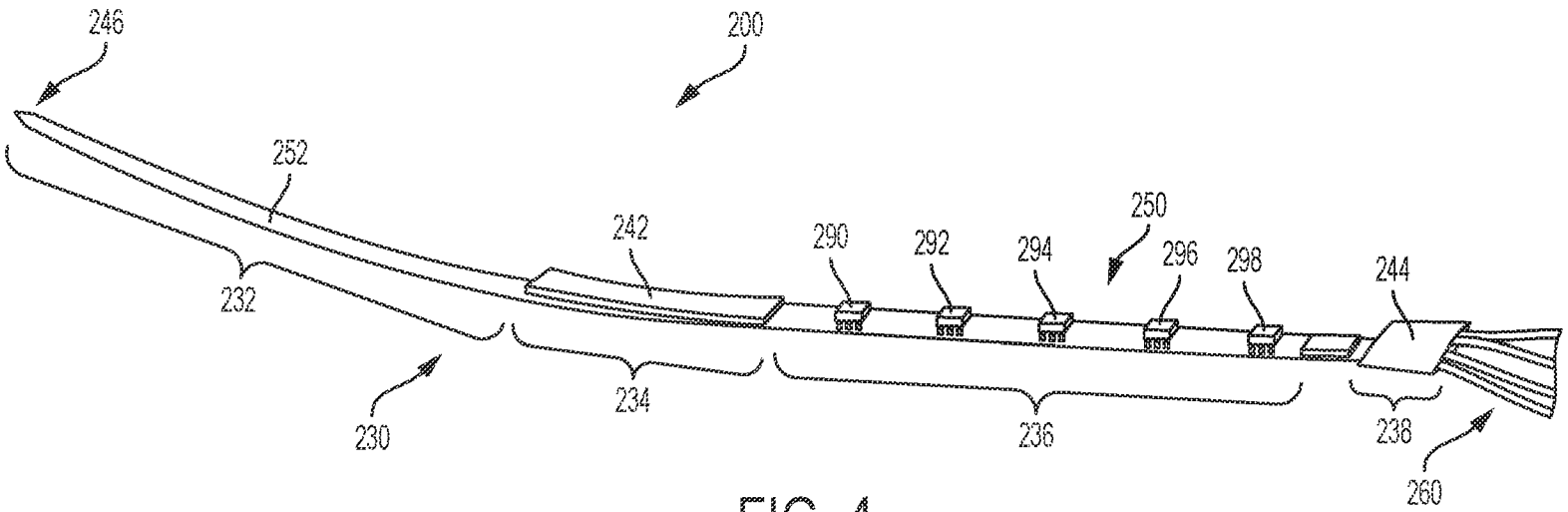
FIG. 4 is an isometric side view of an embodiment of a lighting apparatus.

For example, in FIG. 1, adjacent to article 100, an embodiment of a lighting apparatus 200 is depicted. Together, article 100 and lighting apparatus 200 can comprise a kit of parts or lighting system in some embodiments. As shown in FIGS. 2-4, lighting apparatus 200 can include a plurality of light-emitting devices ("light-emitting devices") 250 in some embodiments. In other embodiments, different mechanical or electrical components may be included, such as circuitry, textiles, or other materials.

In different embodiments, lighting apparatus 200 can comprise different portions. In the top isometric view provided in FIG. 2, it can be seen that lighting apparatus 200 includes a base component 230 joined to a wiring assembly 260. In one embodiment, wiring assembly 260 can be joined to or connect with a port assembly 270. In some embodiments, port assembly 270 may be connected to a region or component in article 100. For example, a different component or mechanism can be associated with article 100, such as a motorized tensioning device, and/or a battery (or other power source), circuitry (or other control mechanism), spools, gears, a motor, light sources, and/or other mechanisms. Thus, in some embodiments, wiring assembly 260 and/or port assembly 270 can include a port or other accommodation for connecting with a component associated with article 100. In some embodiments, these components can provide power and/or a control unit for operating lighting apparatus 200. However, in other embodiments, lighting apparatus 200 may not include a wiring assembly or port assembly. In some embodiments, after a connection has occurred between wiring assembly 260 or port assembly 270 and article 100, it may be desired to install or insert lighting apparatus 200 in article 100. However, it should be understood that installation of lighting apparatus 200 may also occur without any prior (or subsequent) connection to an element of article 100.

Furthermore, for purposes of reference, base component 230 may be understood to comprise different regions or portions in different embodiments. In FIG. 2, it can be seen that base component 230 includes a removable portion 232, a forward portion 234, an intermediate portion 236, and a rearward portion 238. Rearward portion 238 extends between wiring assembly 260 and intermediate portion 236. In addition, intermediate portion 236 extends between rearward portion 238 and forward portion 234, and forward portion 234 extends between intermediate portion 236 and removable portion 232. Furthermore, in some embodiments, as shown in FIG. 2, it can be seen that removable portion 232 extends outward to a tapered end 246.

The materials comprising base component 230 may also affect the ability of base component 230 to be adjusted, bent, twisted, or otherwise moved Thus, in some embodiments, base component 230 may include substantially flexible materials, allowing base component 230 to be bent or curved backward and forward, facilitating insertion of base component 230 into a compartment, for example. In another embodiment, base component 230 may include areas that are more flexible and areas that are more rigid. In one embodiment, base component 230 may comprise a flexible mounting member that may receive or be readily attached to additional elements or components. In some embodiments, base component 230 can include strips or portions of conductive material that extend along different regions or throughout the length of base component 230.

In addition, in some embodiments, tapered end 246 can comprise a free end of base component 230 and can be substantially narrower in width than the remainder of removable portion 232. In some embodiments, tapered end 246 can narrow to a rounded tip or substantially pointed end.

In some embodiments, light-emitting devices 250 are arranged along a first surface side 252 of base component 230 throughout intermediate portion 236. For example, in FIG. 2, a first light-emitting device 290, a second light-emitting device 292, a third light-emitting device 294, a fourth light-emitting device 296, and a fifth light-emitting device 298 are disposed on intermediate portion 236. In different embodiments, one or more light-emitting devices used by the embodiments herein can comprise a semiconductor light source, light-emitting diodes (LED), light-emitting "smart" materials, light-emitting capacitors, or any other type of electroluminescent or light device or source known in the art.

In addition, lighting apparatus 200 can include one or more adhesive portions or elements. An adhesive element can be comprised of various adhesive strips such as peel-off adhesive strips comprised of an adhesive layer or adhesive transfer tape in some cases. The adhesive may include, for example, pressure-sensitive adhesives (rubbers, acrylate, and silicone formulations), dissolvable adhesives, removable adhesives, reactive adhesives, drying adhesives, contact adhesives, light-curing adhesives, thermoplastic adhesives, synthetic adhesives (acrylics, cynoacrylates, silicone, polyurethane), biological adhesives, or any other suitable adhesive known in the art. In other embodiments, a separate adhesive not part of the lighting apparatus may be applied to lighting apparatus 200 along first surface side 252 as a securing mechanism between lighting apparatus 200 and a region of the article. In some embodiments, the adhesive elements can further comprise a backing that can cover the adhesive bonding areas until the adhesive element is ready for use. In FIG. 2, a first adhesive element 242 is disposed along forward portion 234, and a second adhesive element 244 is disposed along rearward portion 238. First adhesive element 242 is a substantially elongated, rectangular element extending between intermediate portion 236 and removable portion 232. Similarly, second adhesive element 244 is a substantially rectangular element extending between intermediate portion 236 and wiring assembly 260. However, in other embodiments, adhesive elements may be associated with any portion of lighting apparatus 200, or there may be no adhesive element.

Furthermore, as shown in FIG. 3, a second surface side 254 of lighting apparatus 200 may be substantially smooth or flat in different embodiments. It can be seen that a substantial majority of base component 230 is comprised of a continuous base material. In one embodiment, the material comprising base component 230 can be smooth in order to facilitate the entry of lighting apparatus 200 into a compartment of the article of footwear. For example, the absence of additional texturing or other elements on the back side (i.e., second surface side 254) of base component 230 can help minimize possible snagging as lighting apparatus 200 is slid into the channel (see FIG. 1).

In the side isometric view of FIG. 4, the relative heights or thickness of various portions of lighting apparatus 200 can be seen. In different embodiments, the dimensions of the various portions of lighting apparatus 200 can differ. For example, the relative length and width of the different segments of base component 230 can differ from those depicted herein. In FIGS. 2-4, base component 230 is a substantially flat, two-dimensional material. The term "two-dimensional" as used throughout this detailed description and in the claims refers to any generally flat material exhibiting a length and width that are substantially greater than the thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of base component 230 could vary and could include various contours or features associated with parts of a foot, for example, a heel region of a foot. Furthermore, base component 230 may be substantially elongated in different embodiments, such that a length of the material is substantially greater than a width of base component 230.

In some embodiments, light-emitting devices 250 may be substantially small, thin disc-like elements disposed along first surface side 252 of base component 230. Each light-emitting device can be spaced apart from a neighboring light-emitting device in some embodiments. In some embodiments, a light-emitting device can comprise a generally rectangular prism or cuboid. A first thickness of first light-emitting device 290 can be approximately two to 10 times the thickness of the material comprising base component 230. In some embodiments, the volume of channel 206 (see FIG. 1) can be configured to securely receive the thickness of the various components located on base component 230. In one embodiment, some portions of lighting apparatus 200 can be sized and dimensioned to be snugly received by the channel. Similarly, any additional components, such as a control circuit 400 (shown in FIG. 4 disposed on intermediate portion 236 nearest to rearward portion 238) may also have a thickness in the range of two to 10 times the thickness of the material comprising base component 230. In other embodiments, however, the dimensions of light-emitting devices 250 can differ from those depicted herein, and can comprise any cross-sectional geometry, including round, oval, square, triangular, or any other regular or irregular shape.

Furthermore, in some embodiments, the thickness of first adhesive element 242 and/or second adhesive element 244 may be less than or substantially similar to the thickness of a light-emitting device disposed on intermediate portion 236 in some embodiments. However, the dimensions of adhesive elements can differ from those depicted herein.

Figure 5:
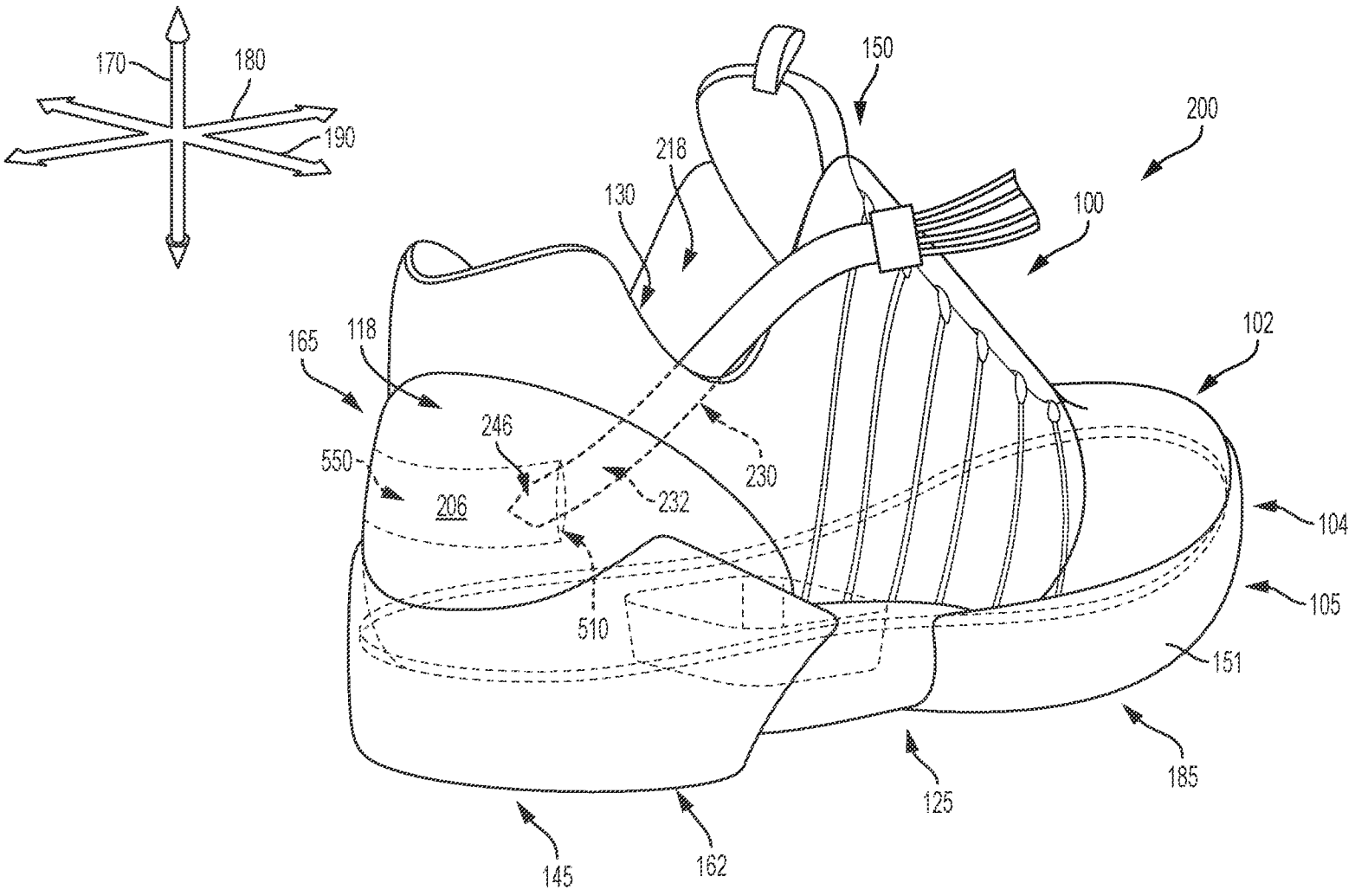
FIG. 5 is an isometric rear view of an embodiment of an article of footwear and a lighting apparatus during the insertion process.

In different embodiments, installation of a component may occur after the initial manufacture of article 100, as noted above. Referring now to FIG. 5, an embodiment of article 100 with the bootie and the collar lining (see FIG. 1) removed is shown. In some embodiments, the removal of certain elements or portions of article 100 may facilitate access to different portions or sections within article 100.

To better illustrate the assembly of lighting apparatus 200 within article 100, FIGS. 5-12 provide an embodiment of a sequence representing different stages of the insertion and installation of lighting apparatus 200. Referring to FIG. 5, lighting apparatus 200 is shown as it is initially inserted into a first opening 510 of channel 206. The elongated, flexible body comprising base component 230 can be first inserted through opening 130 of upper 102 into a portion of interior void 218 associated with heel region 145 in some embodiments. As noted earlier, channel 206 has an elongated, tubular shape. In some embodiments, channel 206 can extend in a direction substantially aligned with lateral axis 190 through rear wall portion 118.

In different embodiments, tapered end 246 can be initially slid into first opening 510. In some embodiments, tapered end 246 can facilitate the entry of removable portion 232 by gently enlarging the slot comprising first opening 510 to more smoothly receive the wider body of removable portion 232. In the embodiment depicted herein, first opening 510 is located on lateral side 185 of heel region 145. However, in other embodiments, first opening 510 can be located along medial side 165.

Figure 6:
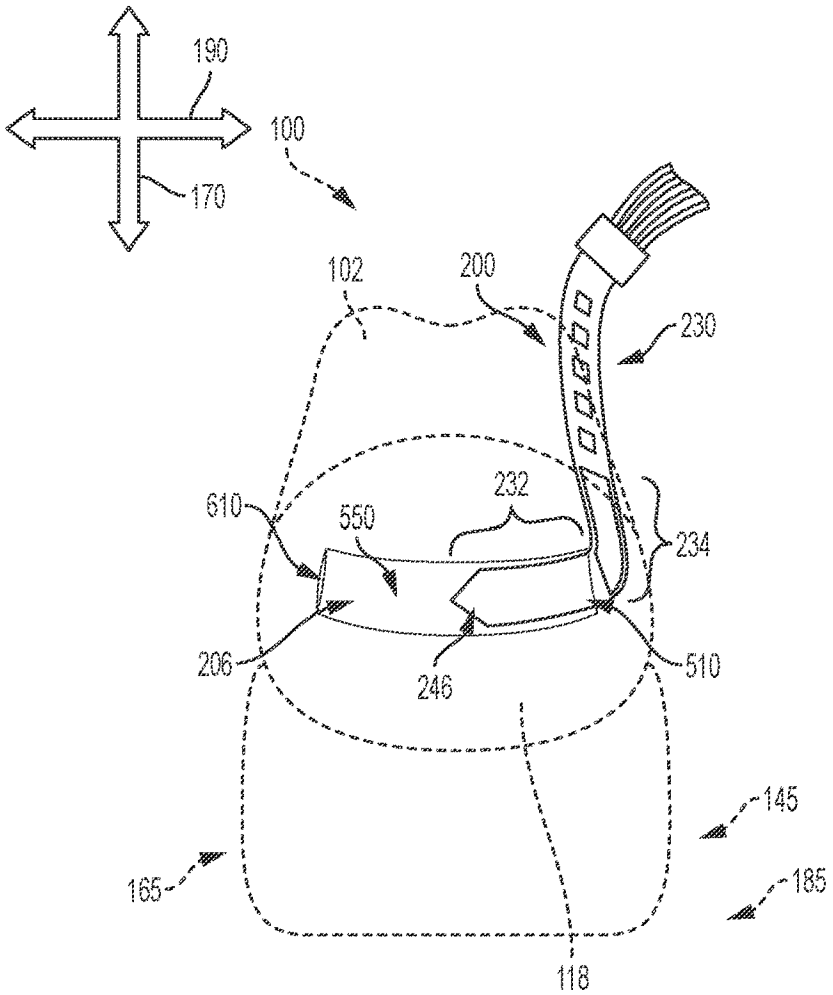
FIG. 6 is a rear view of an embodiment of an article of footwear and a lighting apparatus during the insertion process.

In some embodiments, tapered end 246 is slid into first opening 510; tapered end 246 is enclosed in a tunnel 550, similar to a sleeve. Tunnel 550 may be bounded by one or more sidewall layers that form a region designed or configured for secure and/or snug receipt of lighting apparatus 200. Referring to FIG. 6, first opening 510 as well as tunnel 550 include a diameter greater than a width of removable portion 232. In some embodiments, the diameter of tunnel 550 is substantially constant throughout the length of tunnel 550. Furthermore, the diameter of tunnel 550 can be only slightly greater than that of removable portion 232 in order to provide a snug fit for base component 230.

Figure 7:
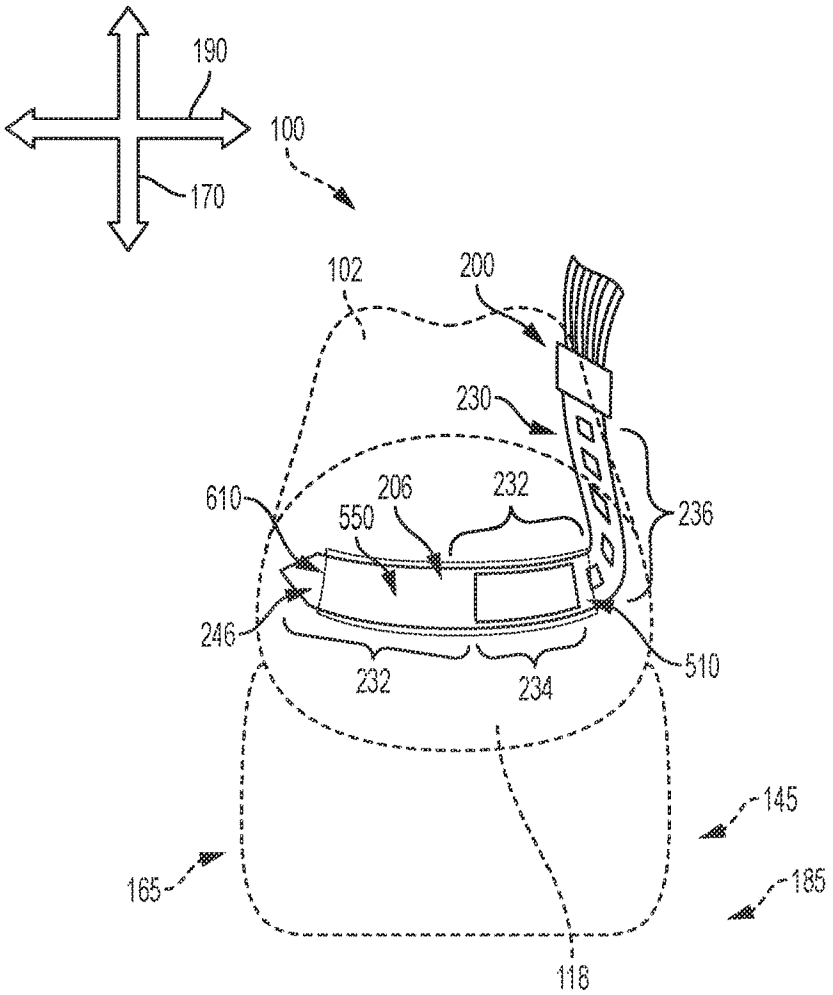
FIG. 7 is a rear view of an embodiment of an article of footwear and a lighting apparatus during the insertion process.

As shown in the rear view of FIGS. 6 and 7, base component 230 can continue to be inserted into tunnel 550 through first opening 510, and tapered end 246 is pointed generally toward a second opening 610 of channel 206. Second opening 610 is associated with medial side 165 of upper 102. In FIG. 6, nearly the entire region comprising removable portion 232 has been slid into and enclosed by the layers of tunnel 550. Forward portion 234 is disposed adjacent to first opening 510. In FIG. 7, lighting apparatus 200 has been inserted further from lateral side 185 toward medial side 165, such that removable portion 232 has begun to emerge from second opening 610, and tapered end 246 protrudes outside of tunnel 550 of channel 206. As base component 230 extends further into channel 206, forward portion 234 can become enclosed in tunnel 550.

Figure 9:
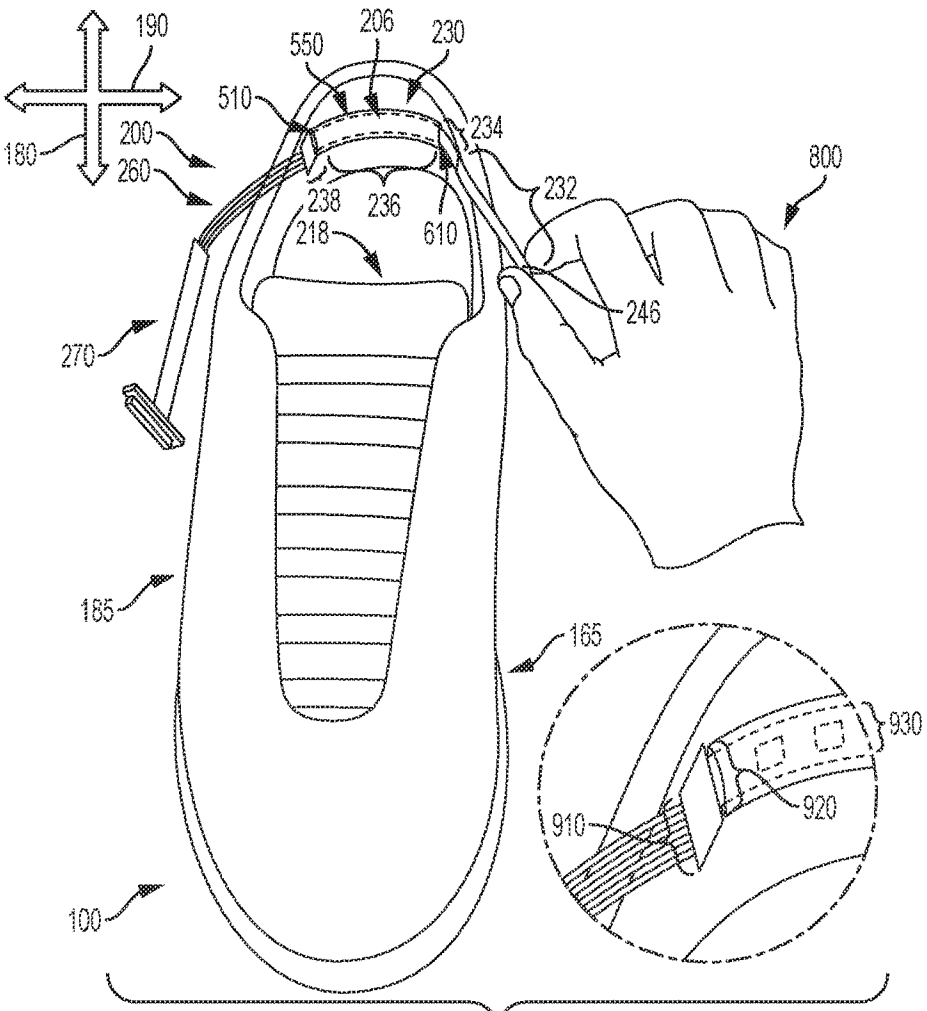
FIG. 9 is an isometric top view of an embodiment of an article of footwear and a lighting apparatus during the insertion process.
Figure 8:
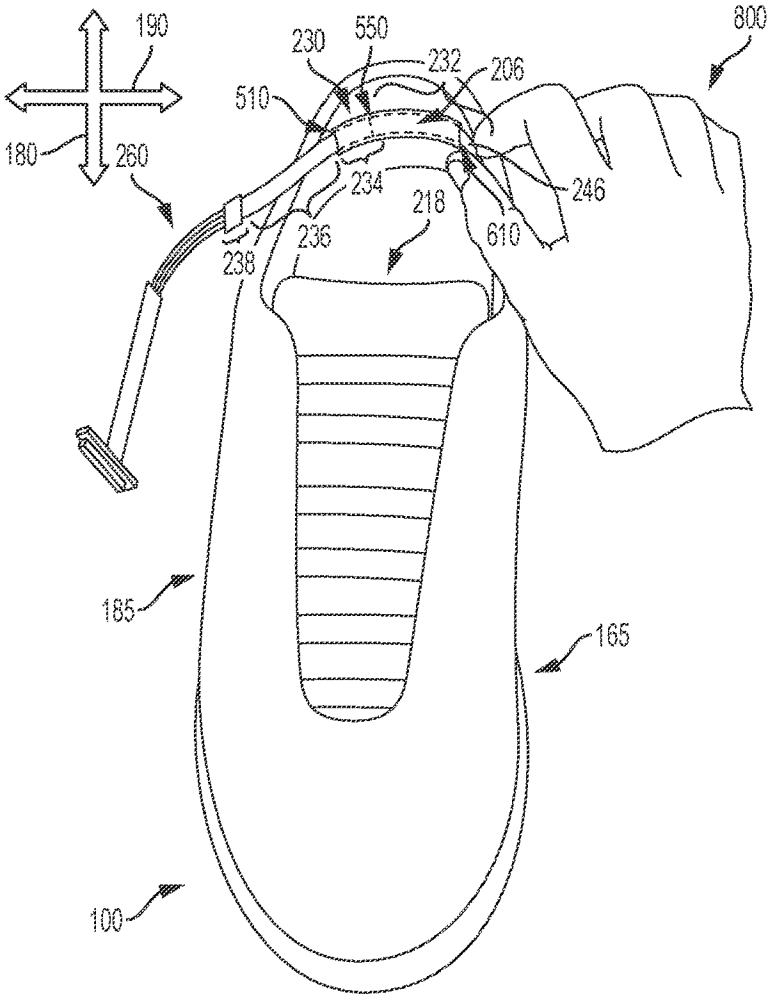
FIG. 8 is an isometric top view of an embodiment of an article of footwear and a lighting apparatus during the insertion process.

Referring now to the top-down isometric views of FIGS. 8 and 9, a third step in the insertion process is shown. As tapered end 246 emerges from second opening 610, shown in FIG. 8, an individual 800 (represented herein by a hand) may grasp tapered end 246. In FIG. 9, individual 800 has pulled on tapered end 246 with a force sufficient to move lighting apparatus 200 further through channel 206. It can be seen that as a result of the pulling force, base component 230 has shifted through channel 206 such that intermediate portion 236 is now disposed entirely within tunnel 550. In other words, while removable portion 232 is now entirely exposed and outside of tunnel 550, intermediate portion 236 has moved through first opening 510 and is encased by the layers forming tunnel 550. Furthermore, in FIG. 9, forward portion 234 has also emerged from second opening 610, adjacent to removable portion 232.

Thus, in some embodiments, while a pushing force was used to move lighting apparatus 200 initially into first opening 510, once a portion of removable portion 232 emerges from second opening 610, a pulling force may be used to continue the insertion process. In other words, removable portion 232 can be utilized as a handle or "sacrificial tail" that can be grasped and allow for the smooth translation of base component 230 through tunnel 550. It should be understood that while the pulling force exerted on base component 230 from second opening 610 occurs by interaction with a hand in FIGS. 8 and 9, in other embodiments, any other type of grasping and/or pulling mechanism may be utilized to move lighting apparatus 200 through channel 206.

In different embodiments, lighting apparatus 200 can include provisions for facilitating assembly in article 100. In some embodiments, dimensions of different portions of lighting apparatus 200 can be configured to limit or hinder the movement of lighting apparatus 200 through channel 206. For example, in the magnified view depicted in FIG. 9, it can be seen that rearward portion 238 has a greater width relative to the remainder of base component 230. In some embodiments, a rear width 910 of rearward portion 238 has a substantially greater width relative to an opening width 920. Similarly, it can be understood that rear width 910 of rearward portion 238 has a substantially greater width relative to a base width 930 of intermediate portion 236. In some embodiments, the greater width of rearward portion 238 relative to the opening leading into tunnel 550 can help block the entry of rearward portion 238 into tunnel 550. In other words, in some cases, rearward portion 238 can be configured to remain outside of the elongated channel. The dimensions of rearward portion 238 can allow rearward portion 238 to act as a shoulder or T-shaped junction that can signal the proper placement and/or positioning of lighting apparatus 200 within tunnel 550. Thus, in one embodiment, the step of properly positioning intermediate portion 236 can further comprise pulling removable portion 232. until an edge of rearward portion 238 is directly adjacent to and/or physically contacts or generally abuts first opening 510.

Figure 11:
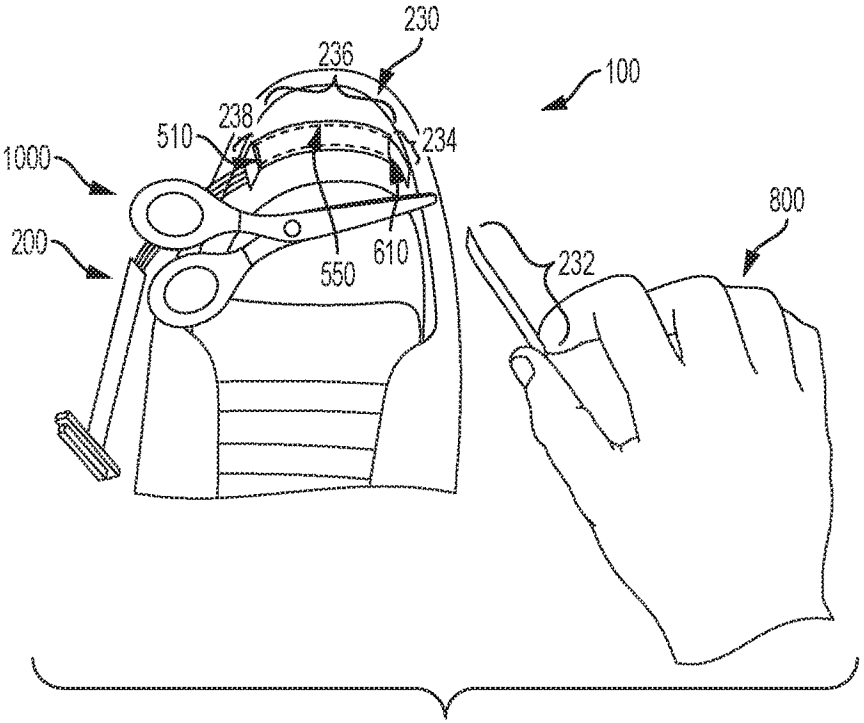
FIG. 11 is an isometric top view of an embodiment of a portion of an article of footwear and a portion of the lighting apparatus being removed.
Figure 10:
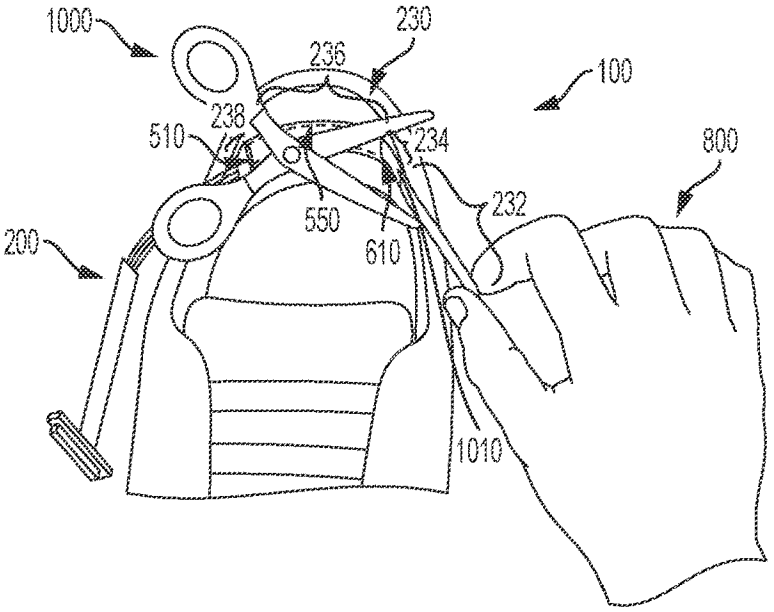
FIG. 10 is an isometric top view of an embodiment of a portion of an article of footwear and a portion of the lighting apparatus being removed.

In different embodiments, there may be provisions for removing or separating portions of base component 230 after installation. For example, in some embodiments, removable portion 232 can be configured for removal from article 100. In some embodiments, there may be a tactile or visual indicator associated with base component 230 that represents the region that can be cut to facilitate the removal of any excess portion of base component 230. In one embodiment, there may be alphanumeric characters visible on removable portion 232. For example, a dotted line may be printed or disposed along a region of base component 230 to provide information regarding the appropriate cut region. In another embodiment, there may be text printed or located on base component 230 such as "Cut Here." Referring to FIGS. 10 and 11, in one embodiment, once removable portion 232. has fully emerged from second opening 610, a pair of scissors ("scissors") 1000—or any other cutting mechanism known in the art—can be utilized to cut through or otherwise divide base component 230. In some embodiments, a demarcated cutting zone 1010 can be associated with the boundary between removable portion 232 and forward portion 234, as shown in FIG. 10. In other embodiments, however, it should be understood that the cutting zone can be associated with other areas of base component 230. In one embodiment, for example, the cutting zone can be located in forward portion 234, such that both removable portion 232 and a portion of forward portion 234 can be cut away from the remainder of base component 230. In FIG. 11, scissors 1000 have been used to cut through demarcated cutting zone 1010 (see FIG. 10), causing a separation of removable portion 232 from forward portion 234.

Figure 12:
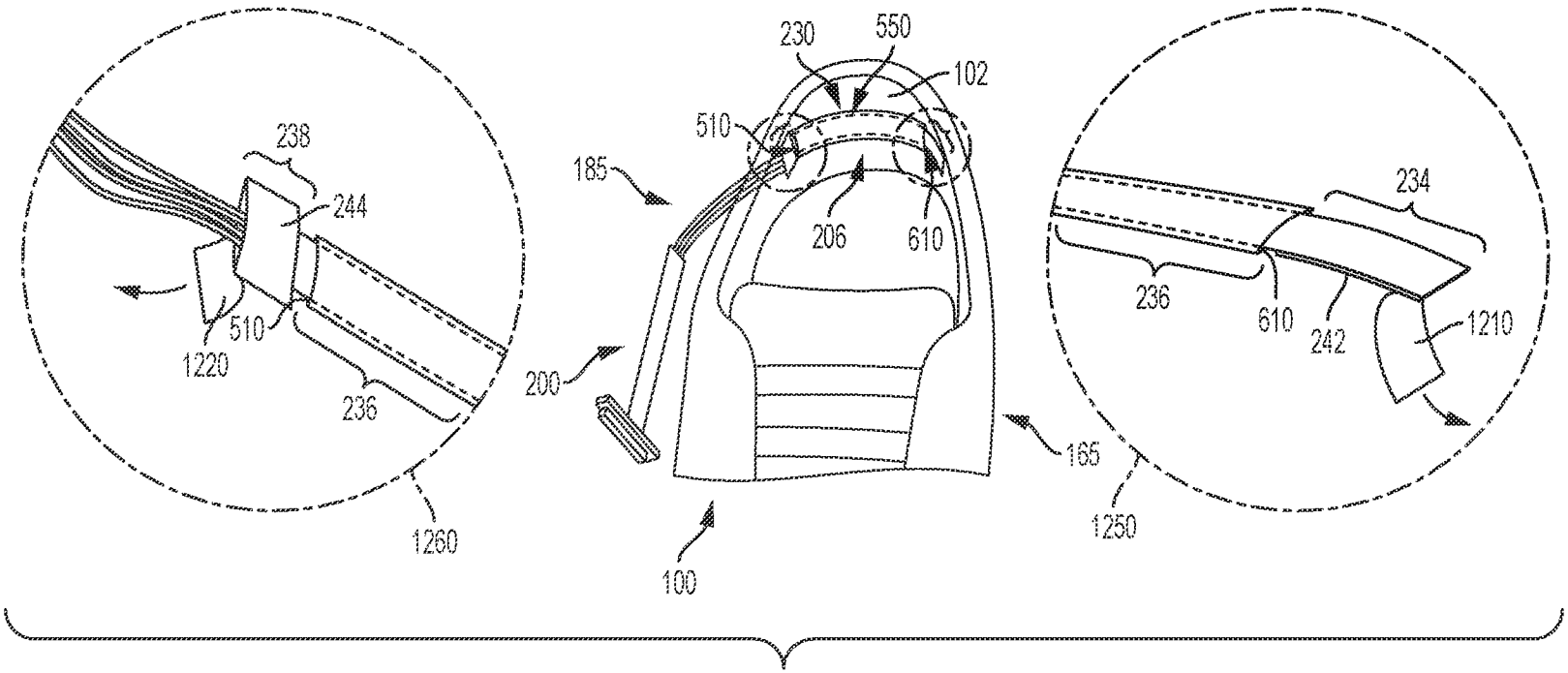
FIG. 12 is an isometric top view of an embodiment of a portion of an article of footwear and a lighting apparatus with adhesive elements.

Thus, in some embodiments, lighting apparatus 200 may be easily deposited or inserted into channel 206 without requiring the removal of interior layers comprising channel 206. Furthermore, lighting apparatus 200 can include provisions for securing lighting apparatus 200 into place. As described earlier, in some embodiments, lighting apparatus 200 can include one or more regions with adhesive elements. In FIG. 12, it can be seen that in one embodiment, first adhesive element 242 is located directly adjacent to first opening 510 and second adhesive element 244 is located directly adjacent to second opening 610. In other embodiments, one or more of the adhesive elements can be positioned further from first opening 510 and/or second opening 610 or can be at least partially disposed within tunnel 550. As depicted in a first magnified view 1250, a first backing 1210 associated with first adhesive element 242 is being removed, and in a second magnified view 1260, a second backing 1220 associated with second adhesive element 244 is being removed. Once each backing is peeled off or otherwise separated from the corresponding adhesive element, the adhesive can be utilized to help secure and anchor intermediate portion 236 of lighting apparatus 200 within channel 206. For example, first adhesive element 242 can be pressed against or otherwise contact a surface of upper 102 adjacent to second opening 610, and second adhesive element 244 can be pressed against or otherwise contact a surface of upper 102 adjacent to first opening 510. However, it should be understood that in other embodiments, any other kind of anchoring, securing, or attachment mechanism may be used to secure lighting apparatus 200 in upper 102.

Figure 14:
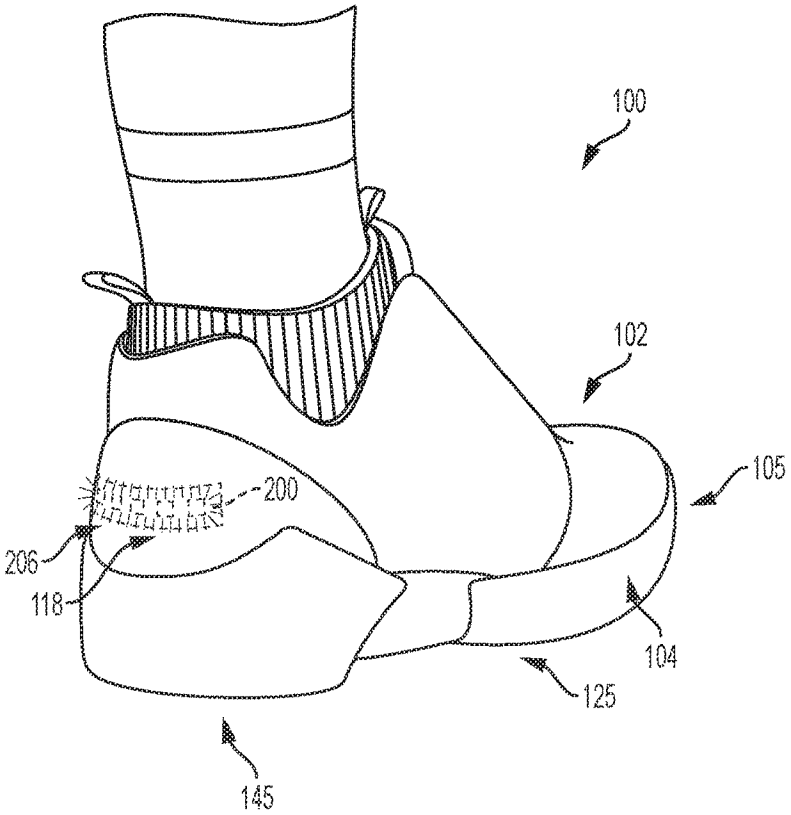
FIG. 14 is an isometric rear view of an embodiment of an article of footwear and a lighting apparatus.
Figure 13:
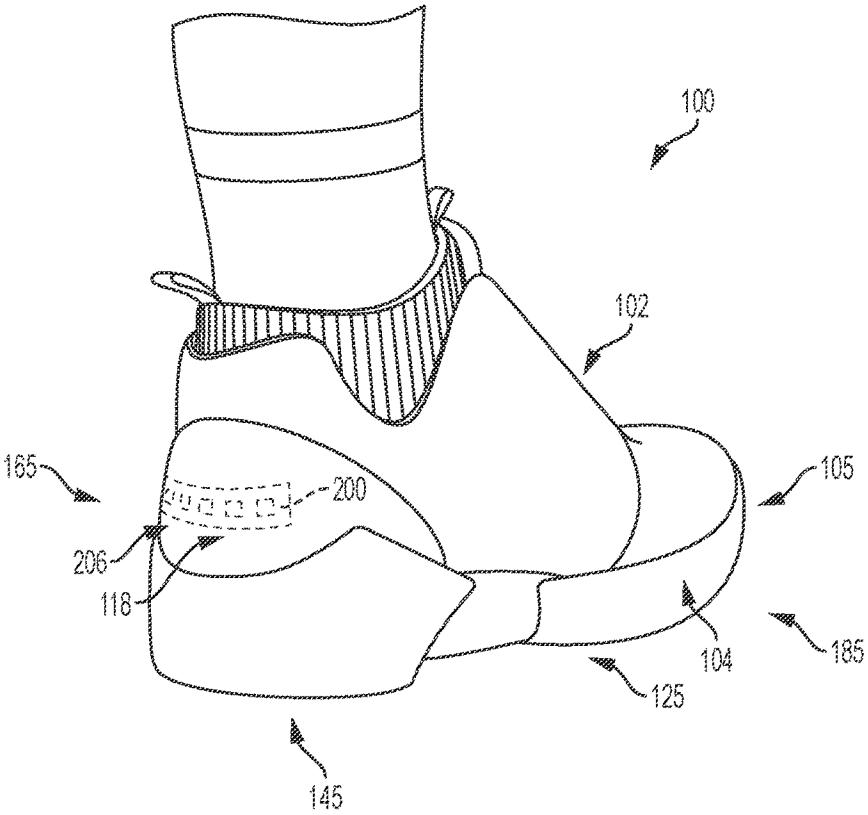
FIG. 13 is an isometric rear view of an embodiment of an article of footwear and a lighting apparatus.

Referring now to FIGS. 13 and 14, article 100 is illustrated with lighting apparatus 200 installed, and the bootie and collar (see FIG. 1) have been returned to resume a position within article 100. Furthermore, the insertion of a bootie and/or collar lining may cover and/or further conceal the various openings of channel 206. In addition, components such as a bootie and/or collar lining can improve the security or incorporation of components within article 100 when they are replaced in upper 102 by pressing or closing off any regions that were exposed for accessibility. In some embodiments, after installation of lighting apparatus 200, article 100 is configured for a ready return to an assembled state, where a user may wear article 100. In FIGS. 13 and 14, upper 102 and sole structure 104 are depicted in solid line, while channel 206 is depicted in dotted line to provide a view of lighting apparatus 200.

Thus, in different embodiments, installation and/or assembly of a lighting apparatus in article 100 can be facilitated by the provisions described herein. In different embodiments, an article may be manufactured that has one or more compartments, such as channel 206, that are configured to receive components. In one embodiment, such as articles with a tensioning system, an article may have multiple components, such as the lighting apparatus, installed after a "first stage" manufacturing process. The first stage manufacturing process can embody the overall manufacture of an article of footwear in some embodiments. Subsequently, in a separate installation process or "second stage" as generally described above one or more components may be installed throughout article 100. In other words, in some embodiments, the lighting apparatus can be inserted into article 100 during a post-manufacturing process. This can increase the efficiency of the production of article 100, and allow for components such as lighting apparatus 200 to be fabricated in one location, and for article 100 to be manufactured in a separate location. In the second stage, the component and the article of footwear can be assembled together. Furthermore, in some embodiments, this process can improve the ability of a manufacturer, retail store provider, or user to make changes or repairs to the components in article 100.

Once the components as described herein have been installed in article 100, various systems may be operated, enjoyed, or used by a wearer. In some embodiments, as a result of the integration of various components within article 100, lighting apparatus 200 can be activated or otherwise operated in article 100. For example, in one embodiment as shown in FIG. 14, a signal may be transmitted to activate the light-emitting devices associated with lighting apparatus 200. Furthermore, some regions of article 100 may be configured for providing optimal use of various components. In one example, one or more regions of article 100 such as rear wall portion 118 may include light-diffusive, light-transmissive, translucent, or transparent materials, to facilitate the transmission of light from a light-emitting device. Referring to FIG. 14, rear wall portion 118 may be formed of a light-diffusive material, for example. Thus, lighting apparatus 200 comprising light-emitting devices may emit light that can be visible to the wearer or others via the diffuse material of rear wall portion 118. In some embodiments, an enhanced aesthetic design may be produced by the use of various materials within lighting apparatus 200.

Thus, in different embodiments, an article may be manufactured that has one or more compartments configured to receive components. In one embodiment, such as articles as described herein, an article may have a component installed after a "first stage" manufacturing process. In a separate installation process or "second stage," as generally described above, one or more components may be installed throughout article 100. This process is generally represented in the flow diagram of FIG. 15, which represents an embodiment of a method for making an article of footwear with a lighting system, where components of the system are installed during a post-manufacturing process.

Figure 15:
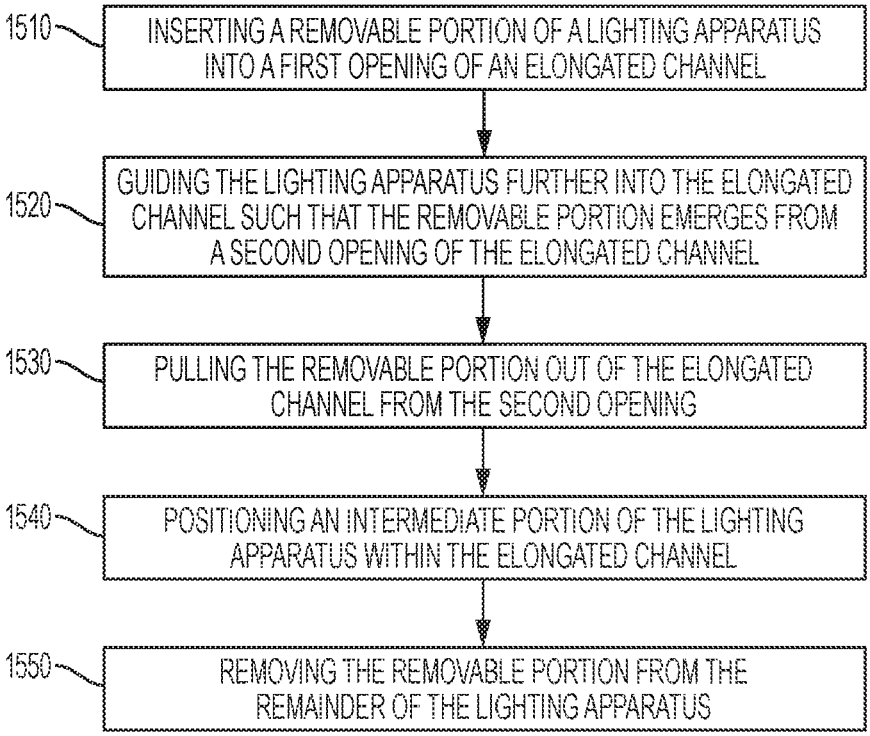
FIG. 15 is an embodiment of a flow chart for a method of assembling an article with a lighting apparatus.

Referring to FIG. 15, in some embodiments, a first step 1510 of a method of assembling a lighting apparatus with an article of footwear may involve inserting a removable portion of a lighting apparatus into a first opening of an elongated channel. For example, the elongated channel can be formed in the article of footwear, as described above. In a second step 1520, the lighting apparatus can be guided further into the elongated channel such that the removable portion emerges from a second opening of the elongated channel. A third step 1530 can comprise pulling the removable portion out of the elongated channel from the second opening. In a fourth step 1540, an intermediate portion of the lighting apparatus can be positioned within the elongated channel. In some embodiments, the intermediate portion can comprise a plurality of light-emitting devices. In addition, a fifth step 1550 can comprise removing the removable portion from the remainder of the lighting apparatus.

In other embodiments, the method can also comprise securing the intermediate portion within the elongated channel using at least one adhesive element. In one embodiment, the method may further comprise removing a backing from an adhesive element. The adhesive element can be disposed on the rearward portion of the lighting apparatus in some embodiments or on a forward portion disposed between the intermediate portion and the removable portion in other embodiments. Furthermore, the step of removing the removable portion can further comprise cutting along a region of the lighting apparatus adjacent to the forward portion. In some embodiments, the step of positioning the intermediate portion can further comprise pulling the removable portion until an edge of the rearward portion is directly adjacent to the first opening.

Thus, the article may be "opened up" without damage to the article, and the cables or other elements/areas that had been assembled within the interior of the shoe during manufacture may be readily accessed in later steps. The embodiments as described herein may occur in rapid succession and in close proximity to one another in some embodiments. However, in other embodiments, one or more steps may occur spaced apart in time and location. In other words, one step may occur in a first location, and another step may occur in a second location, where the first location is different from the second location. For example, the manufacture of the article may occur offsite (e.g., at a factory or manufacturing facility), and the installation of the lighting apparatus may take place at a second, different location (at a shopping outlet, retail store, or a residence, a separate manufacturing facility, etc.). In another example, the manufacture of the article may occur in a "remote site" (e.g., out of state, or abroad), while the actual insertion of the lighting apparatus may occur in a "local site" (e.g., within the country or state where the item or article will be sold and/or used), or vice versa.

While various embodiments have been described, the description is intended to be exemplary, rather than limiting, and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. A kit of parts, comprising:

an article of footwear forming an elongated channel, the elongated channel having a first opening and a second opening; and a lighting apparatus including a base component having a forward portion, a rearward portion, and an intermediate portion extending between the forward portion and the rearward portion, the base component comprising:

an elongated, flexible strip;

a removable portion attached to the forward portion;

a plurality of light-emitting devices being arranged on the intermediate portion;

the base component configured to be extended through the first opening, through the elongated channel, and through the second opening, such that the removable portion extends outward from the second opening; and the removable portion configured to be removed from the lighting apparatus following insertion of the intermediate portion into the elongated channel.

2. The kit of parts of claim 1, wherein the removable portion includes a tapered end.

3. The kit of parts of claim 1, wherein at least one of the forward portion and the rearward portion includes an adhesive element configured to secure the intermediate portion within the elongated channel.

4. The kit of parts of claim 3, wherein a thickness of the adhesive element is less than or substantially similar to the thickness of the plurality of light-emitting devices.

5. The kit of parts of claim 1, wherein the rearward portion is connected to a wiring assembly.

6. The kit of parts of claim 1, wherein the rearward portion has a width that is greater than a width of the intermediate portion.

7. The kit of parts of claim 1, wherein the rearward portion has a width that is greater than a width of the first opening.

8. An article of footwear, comprising:

an upper;

a sole structure secured to the upper, at least one of the upper and the sole structure forming an elongated channel having a first opening and a second opening;

a lighting apparatus including a base component, the base component comprising:

an elongated, flexible strip;

a forward portion, a rearward portion, and an intermediate portion enclosed within the elongated channel and extending between the forward portion and the rearward portion;

a removable portion attached to the forward portion; and a plurality of light-emitting devices arranged on the intermediate portion;

wherein the first opening has a first width, the intermediate portion having a second width, and the rearward portion having a third width;

wherein the second width is smaller than the first width; and wherein the third width is larger than the first width, the rearward portion being configured to remain outside of the elongated channel.

9. The article of footwear of claim 8, wherein the removable portion includes an elongated body and a tapered end.

10. The article of footwear of claim 9, wherein the elongated body has a fourth width, wherein the tapered end has a fifth width, and wherein the fifth width is smaller than the fourth width.

11. The article of footwear of claim 10, wherein the second opening has a sixth width that is similar to the first width, and wherein the fourth width is smaller than the first width.

12. The article of footwear of claim 8, wherein the plurality of light-emitting devices are light-emitting diodes.

13. The article of footwear m of claim 8, wherein at least one of the forward portion and the rearward portion includes an adhesive element.

14. The article of footwear of claim 13, wherein a thickness of the adhesive element is less than or substantially similar to the thickness of the plurality of light-emitting devices.

* * * * *